US007497257B2

(12) United States Patent
Hopkins et al.

(10) Patent No.: US 7,497,257 B2
(45) Date of Patent: Mar. 3, 2009

(54) PARTICLE CONTROL SCREEN WITH DEPTH FILTRATION

(75) Inventors: Sam A. Hopkins, Belews Creek, NC (US); Donald G. Wells, Humble, TX (US)

(73) Assignee: Purolator Facet, Inc., Greensboro, NC (US)

( * ) Notice: Subject to any disclaimer, the term of this patent is extended or adjusted under 35 U.S.C. 154(b) by 0 days.

(21) Appl. No.: 11/509,180

(22) Filed: Aug. 23, 2006

(65) Prior Publication Data

US 2007/0256834 A1 Nov. 8, 2007

Related U.S. Application Data

(60) Provisional application No. 60/797,897, filed on May 4, 2006.

(51) Int. Cl.
*E21B 43/08* (2006.01)
*E21B 43/02* (2006.01)

(52) U.S. Cl. ..... 166/278; 166/233; 166/230; 166/227

(58) Field of Classification Search ..... 166/227, 166/230, 233, 278
See application file for complete search history.

(56) References Cited

U.S. PATENT DOCUMENTS

| | | | | |
|---|---|---|---|---|
| 77,957 | A | 5/1868 | Chapman | |
| 1,256,830 | A | 2/1918 | Rodrigo, Sr. | |
| 2,035,313 | A * | 3/1936 | Griffin | 175/314 |
| 2,342,913 | A | 2/1944 | Williams et al. | |
| 3,216,505 | A | 11/1965 | Johansson | |
| 4,064,938 | A | 12/1977 | Fast | |
| RE31,604 | E * | 6/1984 | Bearden et al. | 166/232 |
| 4,526,230 | A | 7/1985 | Kojicic | |
| 5,339,895 | A | 8/1994 | Arterbury et al. | |
| 5,411,084 | A | 5/1995 | Padden | |
| 5,611,399 | A | 3/1997 | Richard et al. | |
| 5,624,560 | A | 4/1997 | Voll et al. | |
| 5,642,781 | A | 7/1997 | Richard | |
| 5,979,551 | A | 11/1999 | Uban et al. | |
| 6,006,829 | A | 12/1999 | Whitlock et al. | |
| 6,092,604 | A * | 7/2000 | Rice et al. | 166/378 |
| 6,109,349 | A | 8/2000 | Simone et al. | |
| 6,158,507 | A | 12/2000 | Rouse et al. | |
| 6,263,966 | B1 * | 7/2001 | Haut et al. | 166/278 |
| 6,390,192 | B2 | 5/2002 | Doesburg et al. | |
| 6,415,509 | B1 * | 7/2002 | Echols et al. | 29/896.62 |
| 6,514,408 | B1 | 2/2003 | Simone | |
| 6,607,032 | B2 | 8/2003 | Voll et al. | |
| 6,612,481 | B2 | 9/2003 | Bode | |
| 6,659,179 | B2 | 12/2003 | Nguyen | |
| 6,668,920 | B2 | 12/2003 | Setterberg, Jr. | |
| 6,715,544 | B2 | 4/2004 | Gillespie et al. | |
| 6,799,686 | B2 | 10/2004 | Echols et al. | |

(Continued)

*Primary Examiner*—Shane Bomar
(74) *Attorney, Agent, or Firm*—Reinhart Boerner Van Deuren P.C.

(57) ABSTRACT

A particle control screen includes a support layer. A first filter layer is disposed around the support layer. A second filter layer is disposed around the first filter layer. A third filter layer is disposed around the second filter layer. Each of the filter layers has a pore size. The pore size of the third filter layer is greater than the pore size of the second filter layer. The pore size of the second filter layer is greater than the pore size of the first filter layer.

35 Claims, 8 Drawing Sheets

U.S. PATENT DOCUMENTS 6,868,905 B2 3/2005 Lauritzen et al.
6,941,652 B2 9/2005 Echols et al.
2004/0221984 A1 11/2004 Cram

* cited by examiner

PARTICLE CONTROL SCREEN WITH DEPTH FILTRATION

RELATED APPLICATIONS

This application claims the benefit of U.S. Provisional Patent Application No. 60/797,897, filed May 4, 2006, the entire disclosure of which is hereby incorporated herein by reference.

BACKGROUND

The present invention relates to a particle control screen for depth filtration, particularly for use in a well.

Liquids and gases in oil and gas wells typically include particulates that need to be filtered, including sand, clay, and other unconsolidated particulate matter. The presence of sand and other fine particles in the production fluid and well equipment often leads to the rapid erosion of expensive well machinery and hardware.

Subterranean filters, also known as sand screens or well screens, have been used in the petroleum industry to remove particulates from production fluids. The well screens are generally tubular in shape and include a perforated base pipe, a porous filter layer wrapped around and secured to the pipe, and an outer cover. The well screens are used where fluid enters a production string, such that the production fluid must pass through the filter layer and into the perforated pipe prior to entering the production string and being pumped to the surface.

In the context of downhole filtration, woven wire mesh is considered surface filtration, which means that the mesh prevents particles of the desired micron size and larger from passing through the mesh and all the particles are trapped on the top surface of the mesh. Wire wrap is also a common type of surface filtration. Wire wrap is usually triangular shaped wire wrapped around a base pipe, with a given gap between wires to accomplish a micron rating. One difficulty with surface filtration is that as larger particles are captured on the filter layer, the open spaces become smaller and smaller, thus capturing smaller and smaller particles. Eventually the particles being captured are so fine that the filter becomes plugged, severely reducing or stopping flow of formation fluids through the screen to the base pipe.

Large reserves of thick, viscous hydrocarbons exist in locations such as the Orinoco belt in Venezuela and the oil sands of Alberta, as well as fields in Sumatra, China, Brazil, the North Sea, and Kazakhstan. Different names, such as heavy oil, extra heavy oil, oil sands, or bitumen are used to describe the material. Heavy oil is an asphaltic, dense (i.e. low API gravity), and viscous oil that is chemically characterized by the presence of asphaltenes, which are very large molecules incorporating most of the sulfur and metals in the oil. Heavy oil generally has a gravity of less than 22 degrees API gravity and a viscosity of greater than 100 centipoise. Extra-heavy oil is heavy oil having an API gravity of less than 10 degrees. Natural bitumen, also called tar sands or oil sands, generally has a viscosity greater than 10,000 centipoise. Oil sands can include as low as 10% bitumen and 85% or more clay, sand, and rocks. Heavy oil is more difficult to remove from the formation and also includes more particulate matter than conventional oil deposits. Thus, heavy oil is generally also harder to filter than conventional oil deposits.

Thus, there is a need for a downhole filter assembly with improved filtering performance, and especially for use with heavy oil.

BRIEF SUMMARY

In various aspects, the present invention uses depth filtration to trap different size particles at different locations through out the thickness of the filtration media. Larger particles are trapped on the outer layer of mesh with the subsequent layers trapping smaller and smaller particles until reaching the final desired micron rating. This prevents particle build-up from becoming so fine that plugging occurs and increases the particles-holding capacity of the filter, which gives the filter a longer life.

In one aspect, a particle control screen includes a support layer. A first filter layer is disposed around the support layer. A second filter layer is disposed around the first filter layer. A third filter layer is disposed around the second filter layer. Each of the filter layers has a pore size. The pore size of the third filter layer is greater than the pore size of the second filter layer. The pore size of the second filter layer is greater than the pore size of the first filter layer.

In another aspect, a method of filtering a fluid in a downhole formation includes providing an assembly including a base pipe and a particle control screen assembly. The particle control screen assembly includes a support layer, a first filter layer disposed around the support layer, and a second filter layer disposed around the first filter layer. Each of the filter layers has a pore size. The pore size of the second filter layer is greater than the pore size of the first filter layer. At least a first end of the particle control screen assembly is circumferentially welded to the base pipe. The assembly is disposed into a downhole formation comprising a fluid comprising heavy oil. The fluid is drawn in from the formation through the particle control screen assembly and into the base pipe. The particle control screen assembly filters the fluid.

DETAILED DESCRIPTION

Figure 1:
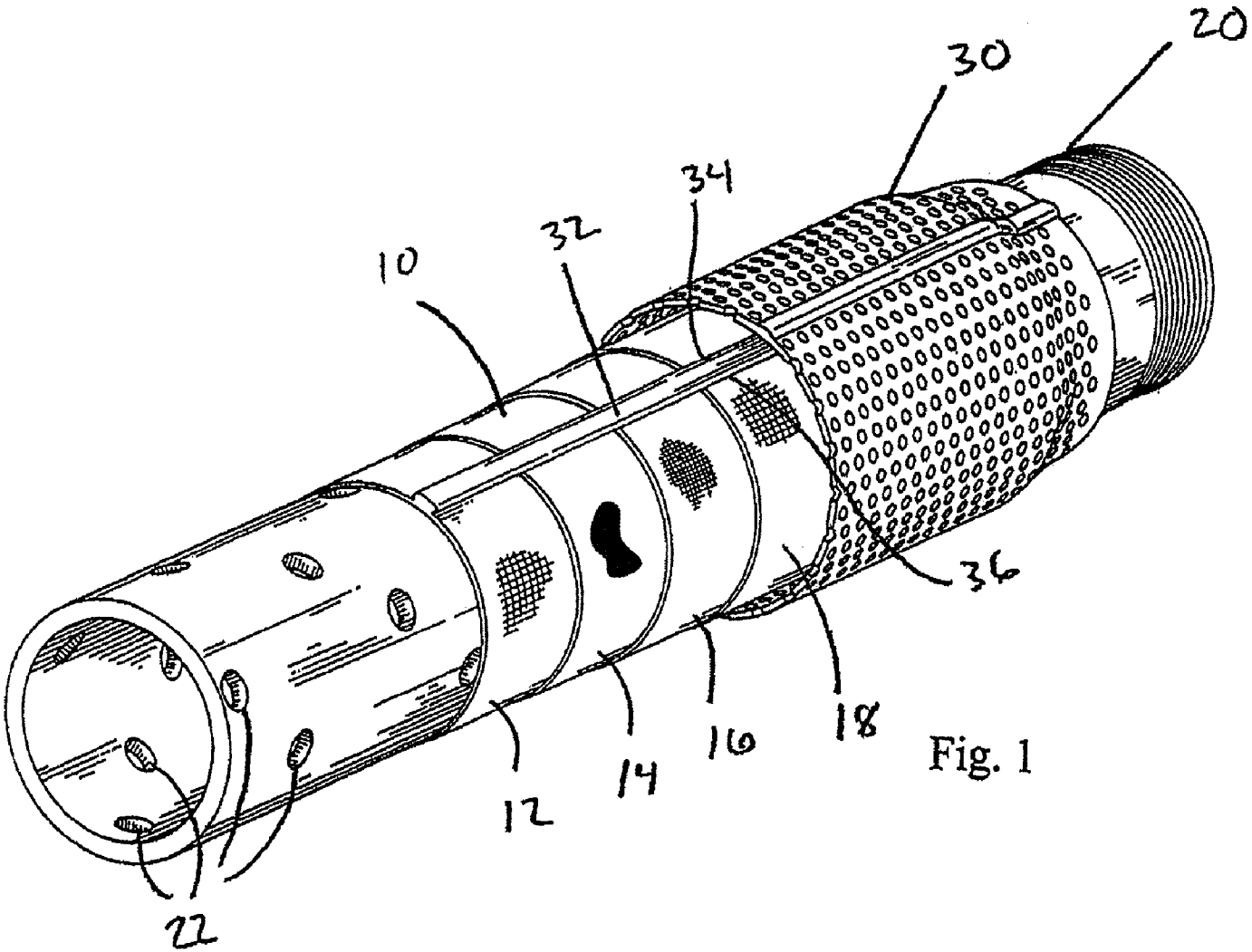
FIG. 1 is a perspective cutaway view of an embodiment of a downhole assembly.

The invention is described with reference to the drawings in which like elements are referred to by like numerals. The relationship and functioning of the various elements of this invention are better understood by the following description. Each aspect so defined may be combined with any other aspect or aspects unless clearly indicated to the contrary. The embodiments as described below are by way of example only, and the invention is not limited to the embodiments illustrated in the drawings.

In conventional surface filtration methods, particles are captured on the filter layer, resulting in an effective micron rating significantly smaller than the micron rating of the original filtration mesh to the extent that plugging of the screen occurs. The present invention uses depth filtration to trap different size particles at different locations throughout the thickness of a filtration media. Larger particles are trapped on the outermost filter layer with the inner layers trapping smaller and smaller particles until reaching the final desired micron rating. Depth filtration prevents the particle build-up from decreasing the micron rating of the filter and increases the particles holding capacity of the filter, giving the filter a longer life.

The present invention is particularly useful for filtering heavy oil. As used herein, the term "heavy oil" includes heavy oil, extra heavy oil, oil sands, tar sand, and bitumen. Because of its high viscosity, heavy oil does not flow readily in conventional wells. Heavy oil can be extracted using several methods including, but not limited to, steam flood, steam assisted gravity drain (SAGD), and cold production. In the steam flood method, injection wells pump steam into the heavy oil reservoir. The pressure of the steam forces the heated heavy oil to adjacent production wells. In SAGD, two horizontal wells are drilled in the oil sands, one at the bottom of the formation and another above it. Steam is injected into the upper well where the heat melts the bitumen. The bitumen flows into the lower well, where it is pumped to the surface. In cold production, the oil is simply pumped out of the formation, often using specialized pumps called progressive cavity pumps. This only works well in areas where the oil is fluid enough to pump. Each of these methods generally results in production fluids with higher particulate content than conventional oil deposits.

Figure 2A:
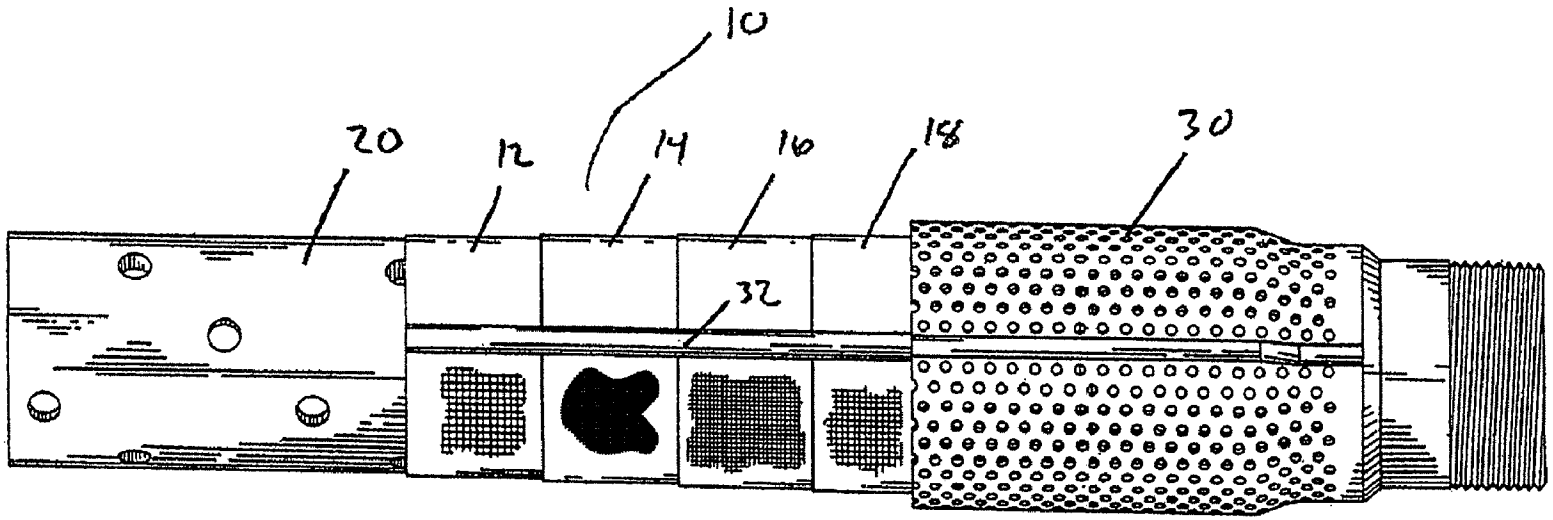
FIG. 2A is a side cutaway view of the downhole assembly of FIG. 1.

Referring to FIGS. 1 and 2A, a first embodiment of a particle control screen assembly 10 is illustrated as being incorporated into a sand or particle filter system. The particle control screen assembly 10 is mounted on a base pipe 20 that may be disposed, for example, in a wellbore. A particle control screen assembly 10 is disposed around the base pipe 20, and a wrapper or shroud 30 is disposed around the particle control screen assembly 10. The wrapper 30 is generally perforated, slotted, or wire wrapped. A portion of the base pipe 20 is perforated with holes 22 to allow petroleum, natural gas, or heavy oil to flow in from the wellbore. To prevent sand and other particles from being drawn into the base pipe 20 through such holes 22, the perforated portion of the base pipe 20 is covered by the particle control screen assembly 10. Although FIG. 1 shows the various layers cut away for viewing purposes, in actual use the layers would typically run substantially the entire length of the base pipe 20.

The particle control screen assembly 10 is typically cylindrically shaped to mate with the base pipe 20. As shown in FIG. 2A, the particle control screen includes at least one support layer 12 and at least two filter layers 14, 16 around the support layer 12. To create a depth filtration effect, the pore size of the outer filter layer 16 is greater than the pore size of the inner filter layer 14. In one embodiment, the particle control screen includes three filters layers 14, 16, 18, where the pore size of the outer filter layer 18 is greater than the pore size of the second filter layer 16, and the pore size of the second filter layer 16 is greater than the pore size of the inner filter layer 14.

The number of filter layers may vary depending on the desired application. For example, in another embodiment, the particle control screen may include a fourth filter layer (not shown) disposed between the support layer 12 and the inner filter layer 14. In other embodiments, the particle control screen may include five, six, or more filter layers.

Figure 2B:
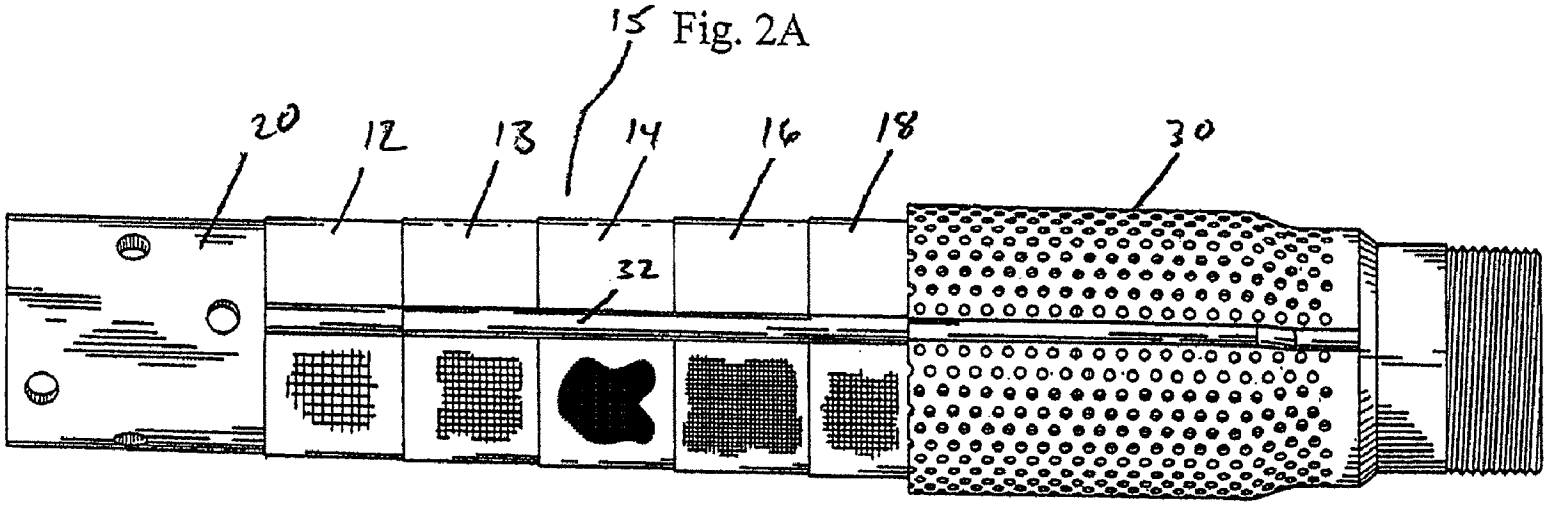
FIG. 2B is a side cutaway view of another embodiment of a downhole assembly.

The support layer 12 provides structural support for the screen assembly 10 and also may act as a drainage layer. The support layer 12 may be woven wire mesh, welded wire, wire wrap, or any other structure which supports the filtration layers and gives flow path for drainage of the formation fluid between the filter media and the base pipe. A second embodiment of the particle control screen 15, shown in FIG. 2B, includes a second support layer 13 disposed around the inner support layer 12. The second support layer 13 provides additional structural support and drainage capacity.

The filter layers 14, 16, 18 may be wire mesh. However, other materials are also possible. The filter layers 14, 16, 18 can be diffusion bonded, sintered, or unsintered. A variety of types of weaves may be used, including square (including both plain or twilled) and dutch (including plain, twilled, reverse or reverse twilled). The filter layers 14, 16, 18 preferably use square mesh to form the depth filtration media. However, the filter layers 14, 16, 18 may also use off-aspect or "off-count" weaves, which are weaves that are plain woven with the warp and the shute wires of the same diameter with different wire counts. It should be noted that the filter layers 14, 16, 18 can be formed using all types of mesh and mesh counts and wire diameters.

Figure 3A:
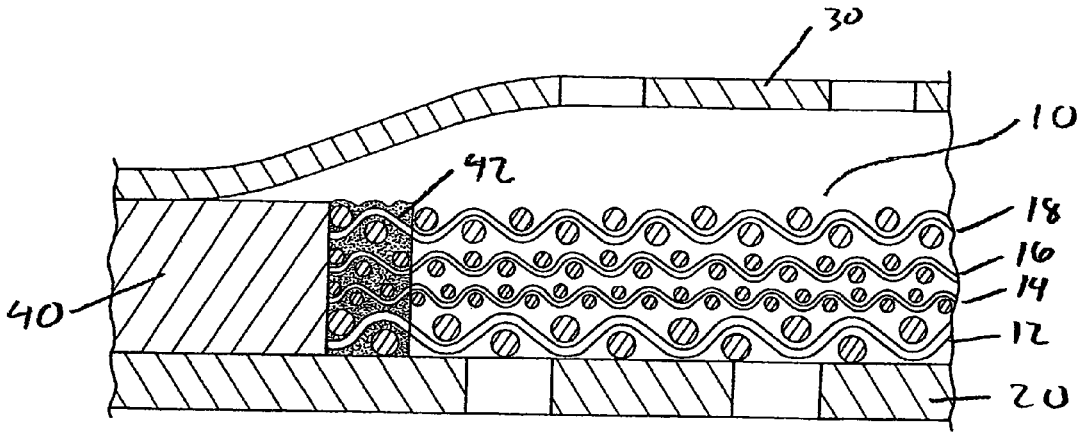
FIG. 3A is a partial cross-sectional view of the downhole assembly of FIG. 1.
Figure 3B:
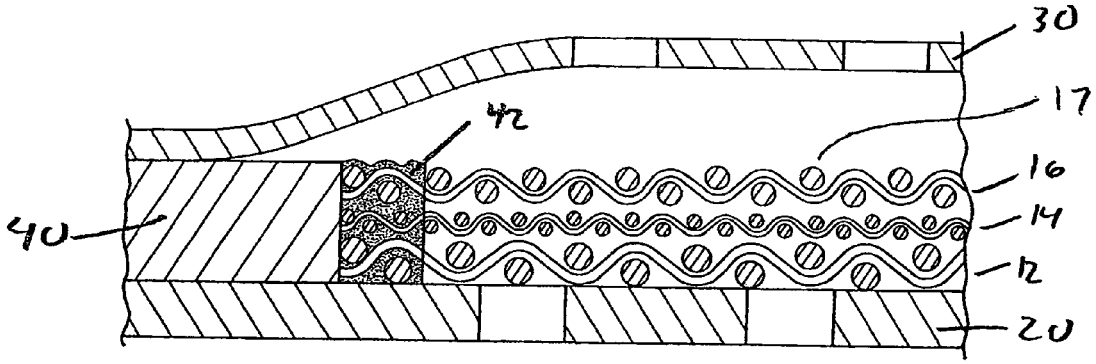
FIG. 3B is a partial cross-sectional view of another embodiment of a downhole assembly.

As shown in FIGS. 3A and 3B, the support layer 12 and filter layers 14, 16, 18 are generally in direct contact with each other. Depending on the application, a cylindrical metal structure 40 may also be used. Metal structure 40 provides a "safe edge" that protects the screen assembly 10 at its end, and can be welded to other structures (such as the base pipe 20) or can be welded upon as desired without concern about burning the screen wires of the mesh layers. The filter layers 14, 16, 18 may also overlap part of the metal structure 40 material and be welded thereto. A circumferential metal weld 42 connects the screen assembly 10 and the cylindrical metal structure 40. In an embodiment shown in FIG. 3B, a particle screen assembly 17 includes one support layer 12 and two filter layers 14 and 16.

Figure 4:
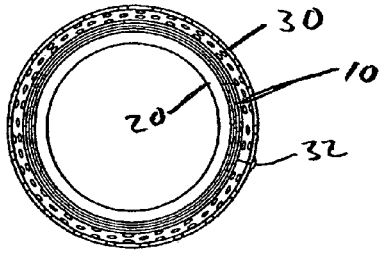
FIG. 4 is an end view of the downhole assembly of FIG. 1.

As shown in FIGS. 3A, 3B, and 4, the support layer 12 and mesh layers 14, 16, 18 are preferably in direct contact with each other with no appreciable gap between the layers. However, it is possible to have gaps between some or all of the layers. Additionally, it is possible to have spacers or other materials, such as additional mesh layers, between the mesh layers. These spacers or additional mesh layers may be especially useful for applications using sintered or diffusion bonded mesh layers. Furthermore, the particle control screen 10 may also be used in expandable screen applications.

As best seen in FIG. 1, the particle control screen 10 desirably includes a longitudinal weld seam 32 running the length of the particle control screen assembly 10. The weld seam 32 seals one edge 34 of the filter layer to the other edge 36. The weld seam 32 may also connect the support layer 12 and filter layers 14, 16, 18 together. As described below, the filter layers may also be spirally wrapped around the base pipe 20.

To provide sufficient sand and particulate filtering, the filter layers 14, 16, 18 have pore sizes to selectively prevent the inflow of certain sizes of particles through the base pipe 20. The first or innermost filter layer 14 preferably has a pore size of between 75 and 300 micron. The second or intermediate filter layer 16 preferably has a pore size of between 150 and 400 micron. The third or outer filter layer 18 preferably has a pore size of between 200 and 1200 micron. An additional filter layer (not shown) may be disposed around the support layer 12 as an innermost layer with a pore size between 75 micron and 150 micron.

Different downhole conditions may involve fluids with different particle size distributions. Thus, the particle size distribution of the fluid may influence the selection of the pore sizes of the mesh layers in the particle control screen assembly. In various embodiments, the first filter layer 14 may have a pore size of between 100 and 200 micron or between 200 and 300 micron. The second filter layer 16 may have a pore size between 150 and 300 micron, between 250 and 350 micron, or between 300 and 450 micron. The third filter layer 18 may have a pore size between 500 and 1200 micron, between 200 and 400 micron, between 500 and 600 micron, or between 600 and 800 micron.

The support or drainage layer(s) 12 (and 13, if present) is typically much coarser than the filter layers. For example, typical sizes for the support layer 12 include 16×16×0.023", 20×20×0.016", and 10×10×0.035". The support layer(s) 12 and/or 13 may also be a much coarser layer (such as 8×8×0.032"), which, however, would make it difficult to integrally weld with the other meshes at the seam. In the event that a coarser support/drainage layer(s) is required, the support/drainage layer(s) would generally not be tied into the seam weld. The support and/or filter layers may also include wire wrap.

At least one end of the particle control screen assembly 10 (and/or metal structure 40) is typically circumferentially welded to the base pipe 20 by weld 42. A wrapper 30 is disposed around the particle control screen and also preferably welded thereto. This arrangement provides a seal between the base pipe 20 and the well formation, such that fluid in the formation cannot enter the base pipe 20 without being filtered by the particle control screen assembly 10.

The operation of the particle control assembly 10 is as follows. The particle control screen assembly 10 is disposed in a downhole or subsurface formation. A fluid comprising a hydrocarbon, such as heavy oil or crude oil, flows through the assembly 10 to the surface. The fluid may also include other components such as natural gas, steam and/or water. The fluid flows either by being pumped therethrough, or due to the pressure existing in the borehole. In flowing through the assembly 10, the fluid first passes through the outer wrapper 30. The outermost filter layer 18 removes relatively large particles from the fluid. The next filter layer 16 removes medium-sized particles from the fluid. The inner filter layer 14 removes smaller particles from the fluid. The fluid then passes through the holes 22 of the base pipe 20 and can then be drawn to the surface. This multi-layer filtering provides more efficient removal of particles than a single-layer filter.

Each filter layer generally has a thickness between 0.005 inch and 0.06 inch. The particle control screen 10 typically has a cross sectional thickness of between about 0.02 inch and about 0.3 inch, preferably between about 0.05 inch and about 0.15 inch, and most preferably between about 0.07 inch and 0.09 inch. In well applications, the particle control screen assembly 10 typically has an axial length of between about 3 feet and about 40 feet. It will be appreciated that actual size ranges can vary depending upon actual well requirements.

Turning now to a method of forming the particle control screen assembly 10, the support layer 12 and filter layers 14, 16, 18 may be diffusion bonded, sintered, or unsintered. For unsintered filter layers, two or more filter layers are stacked, with the mesh sizes depending on the desired filtering qualities. The filter layers are positioned with respect to each other to form a multi-layer unsintered screen. The filter layers may be tacked together to hold them in place for the later fabrication steps. During tacking, the filter layers may be pressed flat by a plate to prevent ripples from forming. Metal strips 40 (shown in FIGS. 3A and 3B) may be attached to opposite ends of the multi-layered unsintered screen. The metal strips 40 are welded to the multi-layered unsintered screen.

The screen is then formed into a generally cylindrical shape. If the longitudinal edges of the layers do not align, they may be trimmed so that the longitudinal edges of each layer are generally coterminous. A plasma cutting machine may be used to trim the longitudinal edges. To accomplish this, the generally cylindrical shape is placed in the plasma cutting machine and secured onto a mandrel. The mandrel is used to hold the generally cylindrical shape securely and also provide a guide for the plasma cutting machine to trim the longitudinal edges. The mandrel includes a milled slot along its length. The plasma torch travels along the mandrel and trims the longitudinal edges of each layer. The trimming process makes possible the formation of a longitudinal weld of unsintered/non-diffusion bonded mesh layers. The longitudinal edges of the mesh layers are then welded together. A longitudinal seam weld 32 is made along the entire length of the tube, as shown in FIG. 1.

Figure 5:
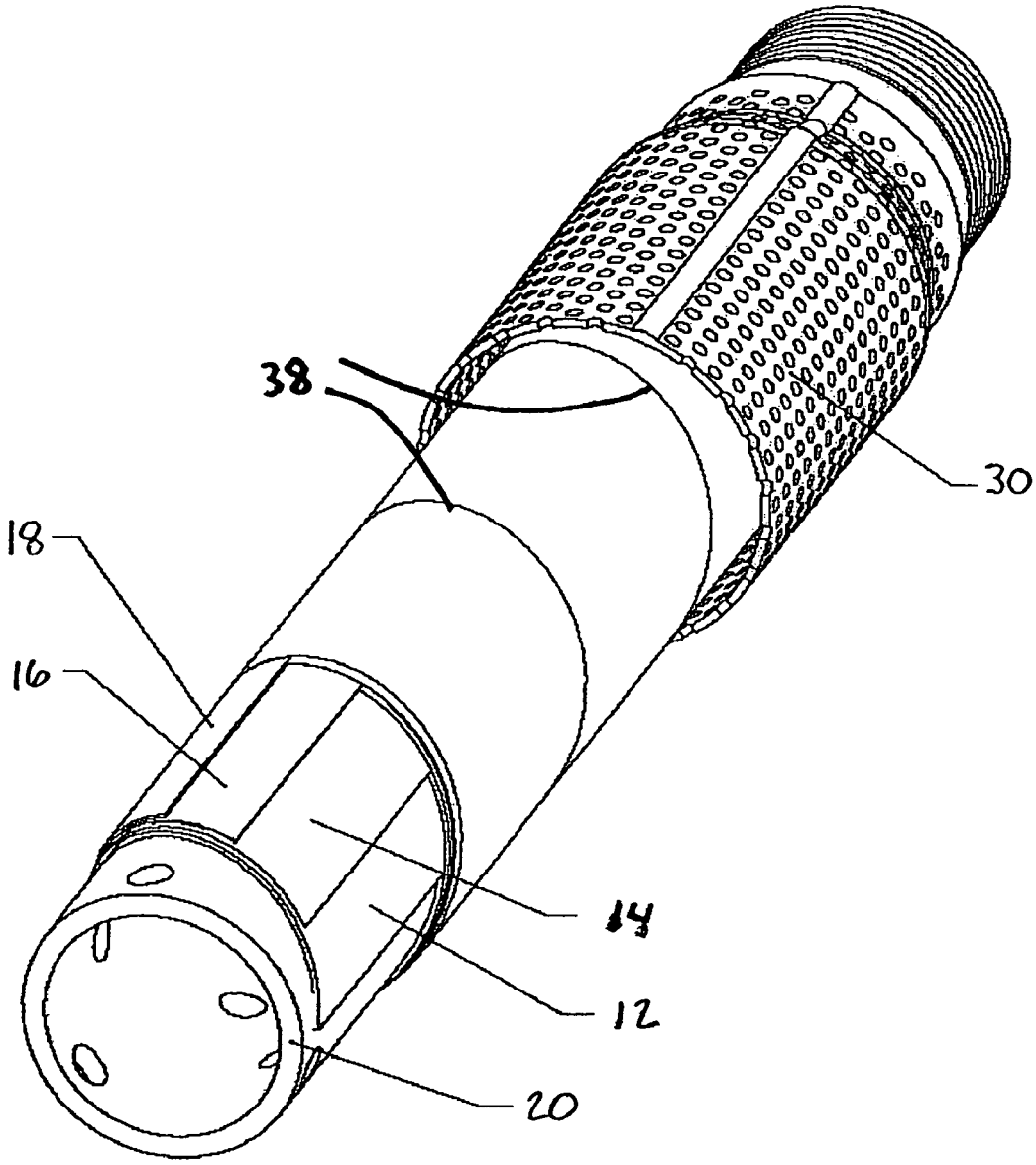
FIG. 5 is a perspective cutaway view of an embodiment of a downhole assembly.

In an alternate form of construction, the filter layers are deposited around the base pipe 20 or support layer 12 by spiral wrapping, as shown in FIG. 5. A long strip of layer mesh including several filter layers is provided. The filter layers 14, 16, 18 are wrapped around the base pipe 20 or other support layer such that the edges of the filter layers overlap at spiral seam 38. Seam 38 spirals axially along the base pipe 20 or other support as the filter layers are wound around the base pipe 20 or other support.

In another alternate method of construction, the filter layers are formed into a generally cylindrical shape and the longitudinal edges of the filter layers are overlapped and welded. The entire filter assembly is then slid into a wrapper for assembly to a base pipe. The ends of the screen are fastened to the base pipe using standard assembly methods including, but not limited to, crimping, swaging or swage and welding.

If the filter layers are to be sintered or diffusion bonded together, two or more layers of filter are stacked, with the mesh sizes depending on the desired filtering qualities. The filter layers are positioned with respect to each other to form a multi-layer screen. The filter layers are then sintered or diffusion bonded together for the later fabrication steps. The support layer(s) may or may not be incorporated into the diffusion bonded laminate depending on application requirements. After the addition of the metal structure 40 (if desired) to each end of the laminate sheet, the screen is then formed into a generally cylindrical shape. The longitudinal edges of the mesh layers are then welded together. A longitudinal seam weld 32 is made along the entire length of the tube.

The welding in each phase of assembly may be accomplished by any known method, including gas tungsten arc welding (GTAW), tungsten inert gas (TIG) welding, plasma welding, metal inert gas (MIG), and laser welding. The material of each weld is conventional and is selected such that it is compatible with the metal of the support tube (which in one embodiment is stainless steel) and the mesh layers (which in one embodiment is stainless steel). The particle control screen assembly may be made from 316L, Carpenter 20Cb3, Inconel 825, and other types of stainless steel filter media to withstand production environments.

The particle screen assembly 10 may be disposed onto a base pipe 20 with any number of wrapper configurations, with circumferential welds being made at each end of the particle screen assembly 10 to form a complete well screen. The particle screen assembly 10 can be assembled along the length of the base pipe 10 in sections of a given length, for example, in four foot, nine foot, or 42 foot sections, whereby each section is then secured to the base pipe 10 such as being welded thereto. Typical lengths for a base pipe are 20, 30 or 40 feet, although shorter or longer lengths are of course possible. In one embodiment, multiple particle control screen assemblies 10 are connected together a particle control assembly tube.

Because the particle control screen assembly 10 uses depth filtration, it has a longer service life than control screens using surface filtration. It also has improved flow rate, reduced risk of erosion in the screen, and reduces the frequency and cost of back-flushing the well when production slows.

EXAMPLES

The following examples of the invention and comparative examples are provided by way of explanation and illustration.

Particle control screen assemblies are prepared using one of the techniques described above.

Example 1

A screen assembly is prepared with a desired filtration micron rating of 125 micron. The screen assembly includes two support layers and four filter layers, as shown in Table 1 below.

TABLE 1

| Layer | Mesh size | Pore size |
|---|---|---|
| Outer filter | 30 × 30 × 0.012 | 540 micron |
| Intermediate filter | 50 × 50 × 0.009 | 280 micron |
| Intermediate filter | 80 × 80 × 0.0055 | 180 micron |
| Inner filter | 24 × 110 | 125 micron |
| Outer support layer | 20 × 20 × 0.016 | |
| Inner support layer | 16 × 16 × 0.023 | |

Example 2

A screen assembly is prepared with a desired filtration micron rating of 180 micron. The screen assembly includes two support layers and three filter layers, as shown in Table 2 below.

TABLE 2

| Layer | Mesh size | Pore size |
|---|---|---|
| Outer filter | 30 × 30 × 0.012 | 540 micron |
| Intermediate filter | 50 × 50 × 0.009 | 280 micron |
| Inner filter | 80 × 80 × 0.0055 | 180 micron |
| Outer support layer | 20 × 20 × 0.016 | |
| Inner support layer | 16 × 16 × 0.023 | |

Example 3

A screen assembly is prepared with a desired filtration micron rating of 250 micron. The screen assembly includes one support layer and three filter layers, as shown in Table 3 below.

TABLE 3

| Layer | Mesh size | Pore size |
|---|---|---|
| Outer filter | 24 × 24 × 0.014 | 700 micron |
| Intermediate filter | 40 × 40 × 0.010 | 380 micron |
| Inner filter | 12 × 95 | 250 micron |
| Support layer | 16 × 16 × 0.023 | |

Example 4

A screen assembly is prepared with a desired filtration micron rating of 425 micron. The screen assembly includes one support layer and two filter layers, as shown in Table 4 below.

TABLE 4

| Layer | Mesh size | Pore size |
|---|---|---|
| Outer filter | 24 × 24 × 0.014 | 700 micron |
| Inner filter | 132 × 16 | 400-450 micron |
| Support layer | 10 × 10 × 0.035 | |

Example 5

A screen assembly is prepared with a desired filtration micron rating of 125 micron. The screen assembly includes two support layers and five filter layers, as shown in Table 5 below.

TABLE 5

| Layer | Mesh size | Pore size |
|---|---|---|
| Outer filter | 50 × 50 × 0.009 | 280 micron |
| Intermediate filter | 60 × 60 × 0.0075 | 230 micron |
| Intermediate filter | 70 × 70 × 0.0065 | 200 micron |
| Intermediate filter | 80 × 80 × 0.0055 | 180 micron |
| Inner filter | 24 × 110 | 125 micron |
| Outer support layer | 20 × 20 × 0.016 | |
| Inner support layer | 16 × 16 × 0.023 | |

Example 6

A screen assembly is prepared with a desired filtration micron rating of 150 micron. The screen assembly includes a wire wrap and four other filter layers, as shown in Table 6 below.

TABLE 6

| Layer | Mesh size | Pore size |
|---|---|---|
| Outer filter | 30 × 30 × 0.012 | 540 micron |
| Intermediate filter | 40 × 40 × 0.010 | 380 micron |
| Intermediate filter | 60 × 60 × 0.0075 | 230 micron |
| Intermediate filter | 80 × 80 × 0.0055 | 180 micron |
| Wire Wrap | | 150 micron |

Example 7

A screen assembly is prepared with a desired filtration micron rating of 150 micron. The screen assembly includes a wire wrap and four other filter layers, as shown in Table 7 below.

TABLE 7

| Layer | Mesh size | Pore size |
|---|---|---|
| Outer filter | 50 × 50 × 0.009 | 280 micron |
| Intermediate filter | 60 × 60 × 0.0075 | 230 micron |
| Intermediate filter | 70 × 70 × 0.0065 | 200 micron |
| Intermediate filter | 80 × 80 × 0.0055 | 180 micron |
| Wire Wrap | | 150 micron |

Example 8

A screen assembly is prepared with a desired filtration micron rating of 140 micron. The screen assembly includes two support layers and five filter layers, as shown in Table 8 below. The filter layers are square weave.

TABLE 8

| Layer | Mesh size | Pore size |
|---|---|---|
| Outer filter | 50 × 50 × 0.009 | 280 micron |
| Intermediate filter | 60 × 60 × 0.0075 | 230 micron |
| Intermediate filter | 70 × 70 × 0.0065 | 200 micron |
| Intermediate filter | 80 × 80 × 0.0055 | 180 micron |
| Inner filter | 100 × 100 × 0.0045 | 140 micron |
| Outer support layer | 30 × 30 × 0.012 | |
| Inner support layer | 16 × 16 × 0.023 | |

Example 9

A screen assembly is prepared with a desired filtration micron rating of 125 micron. The screen assembly includes two support layers and six filter layers, as shown in Table 9 below. The inner filtration layer is plain Dutch weave.

TABLE 9

| Layer | Mesh size | Pore size |
|---|---|---|
| Outer filter | 30 × 30 × 0.012 | 540 micron |
| Intermediate filter | 40 × 40 × 0.010 | 380 micron |
| Intermediate filter | 50 × 50 × 0.009 | 280 micron |
| Intermediate filter | 70 × 70 × 0.0065 | 200 micron |
| Intermediate filter | 100 × 100 × 0.0045 | 140 micron |
| Inner filter | 24 × 110 | 125 micron |
| Outer support layer | 20 × 20 × 0.016 | |
| Inner support layer | 16 × 16 × 0.023 | |

Example 10

A screen assembly is prepared with a desired filtration micron rating of 150 micron. The screen assembly includes one support layer and five filter layers, as shown in Table 10 below. The inner filtration layer is plain Dutch twill weave.

TABLE 10

| Layer | Mesh size | Pore size |
|---|---|---|
| Outer filter | 30 × 30 × 0.012 | 540 micron |
| Intermediate filter | 40 × 40 × 0.010 | 380 micron |
| Intermediate filter | 50 × 50 × 0.009 | 280 micron |
| Intermediate filter | 70 × 70 × 0.0065 | 200 micron |
| Inner filter | 20 × 216 | 150 micron |
| Support layer | 16 × 16 × 0.023 | |

Example 11

A screen assembly is prepared with a desired filtration micron rating of 180 micron. The screen assembly includes two support layers and four filter layers, as shown in Table 11 below. The inner filtration layer is a twill square weave.

TABLE 11

| Layer | Mesh size | Pore size |
|---|---|---|
| Outer filter | 50 × 50 × 0.009 | 280 micron |
| Intermediate filter | 60 × 60 × 0.0075 | 230 micron |
| Intermediate filter | 70 × 70 × 0.0065 | 200 micron |
| Inner filter | 80 × 80 × 0.0055 | 180 micron |
| Outer support layer | 30 × 300.012 | |
| Inner support layer | 16 × 16 × 0.023 | |

Example 12

A screen assembly is prepared with a desired filtration micron rating of 180 micron. The screen assembly includes two support layers and three filter layers, as shown in Table 12 below. The inner filtration layer is a plain square weave.

TABLE 12

| Layer | Mesh size | Pore size |
|---|---|---|
| Outer filter | 60 × 60 × 0.0075 | 230 micron |
| Intermediate filter | 70 × 70 × 0.0065 | 200 micron |
| Inner filter | 80 × 80 × 0.0055 | 180 micron |
| Outer support layer | 30 × 30 × 0.012 | |
| Inner support layer | 16 × 16 × 0.023 | |

Example 13

A screen assembly is prepared with a desired filtration micron rating of 140 micron. The screen assembly includes two support layers and four filter layers, as shown in Table 13 below. The inner filtration layer is a plain square weave.

TABLE 13

| Layer | Mesh size | Pore size |
|---|---|---|
| Outer filter | 60 × 60 × 0.0075 | 230 micron |
| Intermediate filter | 80 × 80 × 0.0055 | 180 micron |
| Intermediate filter | 105 × 105 × 0.003 | 170 micron |
| Inner filter | 100 × 100 × 0.0045 | 140 micron |
| Outer support layer | 30 × 30 × 0.012 | |
| Inner support layer | 16 × 16 × 0.023 | |

Example 14

A screen assembly is prepared with a desired filtration micron rating of 140 micron. The screen assembly includes two support layers and five filter layers, as shown in Table 14 below. The inner filtration layer is a plain square weave.

TABLE 14

| Layer | Mesh size | Pore size |
|---|---|---|
| Outer filter | 50 × 50 × 0.009 | 280 micron |
| Intermediate filter | 60 × 60 × 0.0075 | 230 micron |
| Intermediate filter | 80 × 80 × 0.0055 | 180 micron |
| Intermediate filter | 105 × 105 × 0.003 | 170 micron |

TABLE 14-continued

| Layer | Mesh size | Pore size |
|---|---|---|
| Inner filter | 100 × 100 × 0.0045 | 140 micron |
| Outer support layer | 30 × 30 × 0.012 | |
| Inner support layer | 16 × 16 × 0.023 | |

Example 15

A screen assembly is prepared with a desired filtration micron rating of 140 micron. The screen assembly includes two support layers and six filter layers, as shown in Table 15 below. The inner filtration layer is a plain square weave.

TABLE 15

| Layer | Mesh size | Pore size |
|---|---|---|
| Outer filter | 50 × 50 × 0.009 | 280 micron |
| Intermediate filter | 60 × 60 × 0.0075 | 230 micron |
| Intermediate filter | 70 × 70 × 0.0065 | 200 micron |
| Intermediate filter | 80 × 80 × 0.0055 | 180 micron |
| Intermediate filter | 105 × 105 × 0.003 | 170 micron |
| Inner filter | 100 × 100 × 0.0045 | 140 micron |
| Outer support layer | 30 × 30 × 0.012 | |
| Inner support layer | 16 × 16 × 0.023 | |

Comparative Example A

By way of comparison, a Poromax® product, a prior art screen assembly, has a desired filtration micron rating of 125 micron. The screen assembly includes two support layers and a filter layer, as shown in Table 16 below.

TABLE 16

| Layer | Mesh size | Pore size |
|---|---|---|
| Filter layer | 24 × 110 | 125 micron |
| Outer support layer | 20 × 20 × 0.016 | |
| Inner support layer | 16 × 16 × 0.023 | |

Comparative Example B

A screen assembly is prepared with a desired filtration micron rating of 150 micron. The screen assembly includes a commercially available wire wrap screen. The wire wrap screen consisted of 0.090 wedge wire with 0.006" gaps between wires, and 0.125" diameter support wires on ⅝" spacing.

Comparative Example C

A screen assembly is prepared with a desired filtration micron rating of 150 micron. The screen assembly includes two support layers and a filter layer, as shown in Table 17 below.

TABLE 17

| Layer | Mesh size | Pore size |
|---|---|---|
| Filter layer | 20 × 216 | 150 micron |
| Outer support layer | 20 × 20 × 0.016 | |
| Inner support layer | 16 × 16 × 0.023 | |

Tests were conducted to evaluate the relative effectiveness of various configurations of screens. Discs were prepared using the layouts of Examples 9-15 and Comparative Examples A-C. The discs had diameters of 1.885 inches and were sealed in an apparatus to provide a flow diameter of 1.550 inches. Tests were conducted using two types of test fluids with viscosities and particulate matter modeled on typical downhole conditions. The first fluid was modeled on a typical South American fluid and the second fluid on a typical Asian fluid. A supply tank was filled with the desired test fluid. The test fluid was pumped through 2 μm absolute clean-up filter for 2 hours. Particulate matter was added to achieve a concentration of 0.10 grams/L. A sample of test fluid was tested to confirm fluid particulate level. A disc incorporating a screen configuration was placed in a housing. The test fluid was circulated through the disc at a flow rate of 200 ml/min. The pressure drop across the disc was measured through the course of the test. Fluid samples downstream of the disc were obtained to determine the amount of particles retained by the disc.

Figure 6:
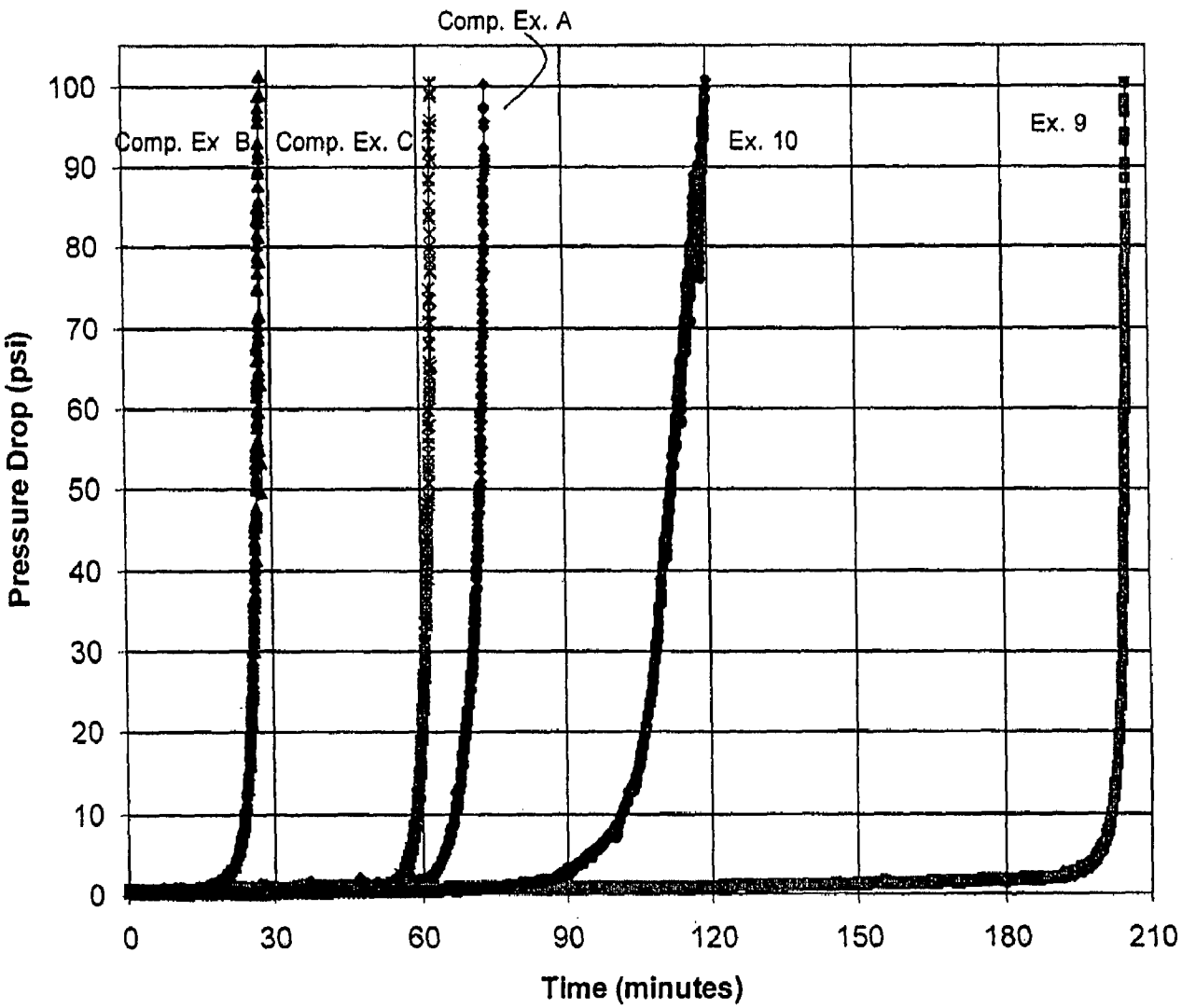
FIG. 6 is a graph showing the pressure drop as a function of time for tests involving various screen assemblies.
Figure 7:
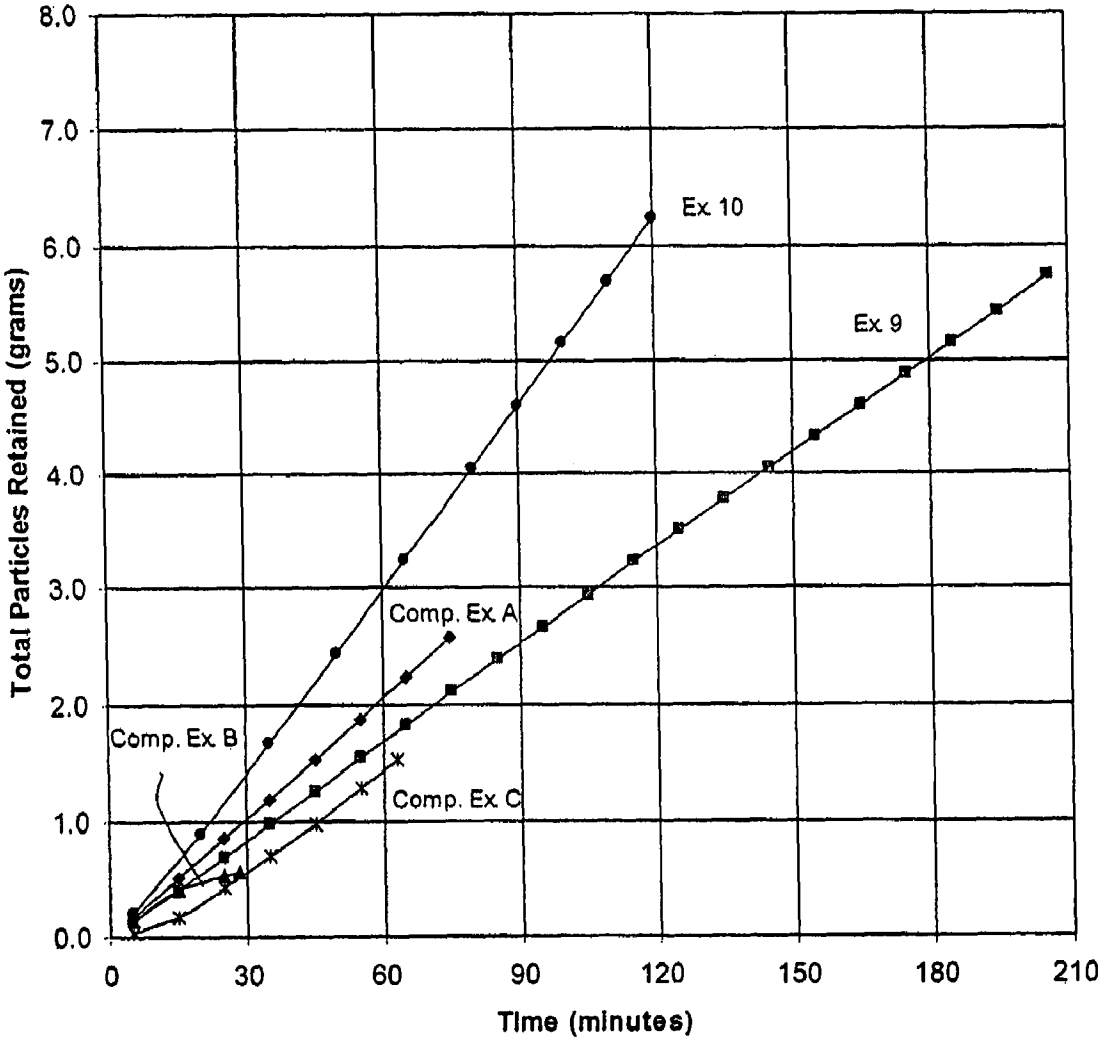
FIG. 7 is a graph showing the amount of retained particles as a function of time for tests involving various screen assemblies.

The results for the South American fluid are shown in FIGS. 6 and 7. FIG. 6 shows the pressure drop as a function of time for samples prepared from the screen configurations of Examples 9 and 10 and Comparative Examples A-C. The time at which the pressure drop rises rapidly coincides with plugging of the filter, and thus provides a useful estimate of the filter life. It can be seen the screen configurations of Examples 9 and 10 provide much longer service life, and thus superior performance, than the screen configurations of the Comparative Examples. FIG. 7 is a graph showing the amount of retained particles as a function of time for samples prepared from the screen configurations of Examples 9 and 10 and Comparative Examples A-C. It can be seen that the inventive screens removed acceptable amounts of particles, and removed a greater amount of particles over the life of the filter than the screens of the Comparative Examples.

Figure 8:
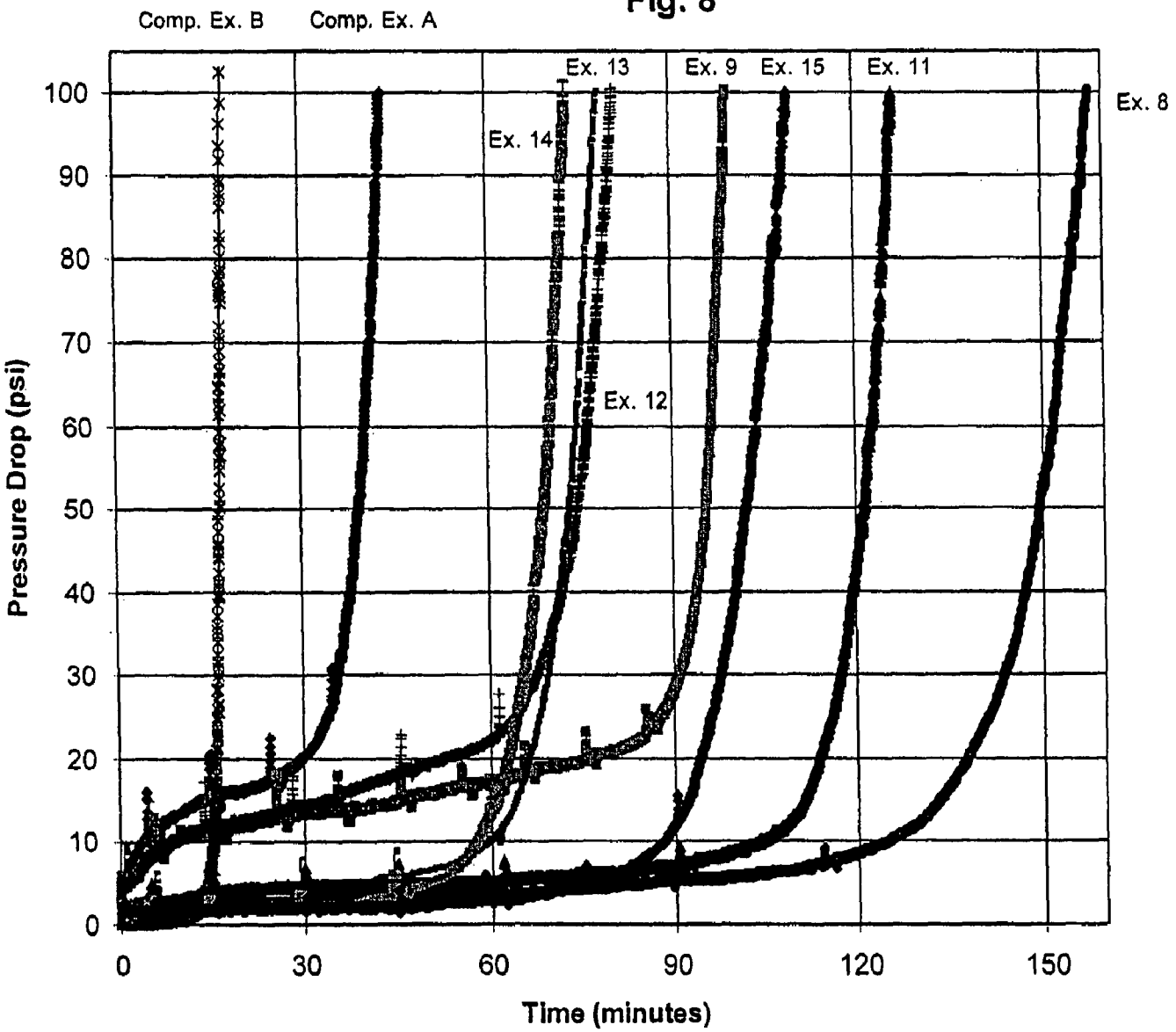
FIG. 8 is a graph showing the pressure drop as a function of time for tests involving various screen assemblies
Figure 9:
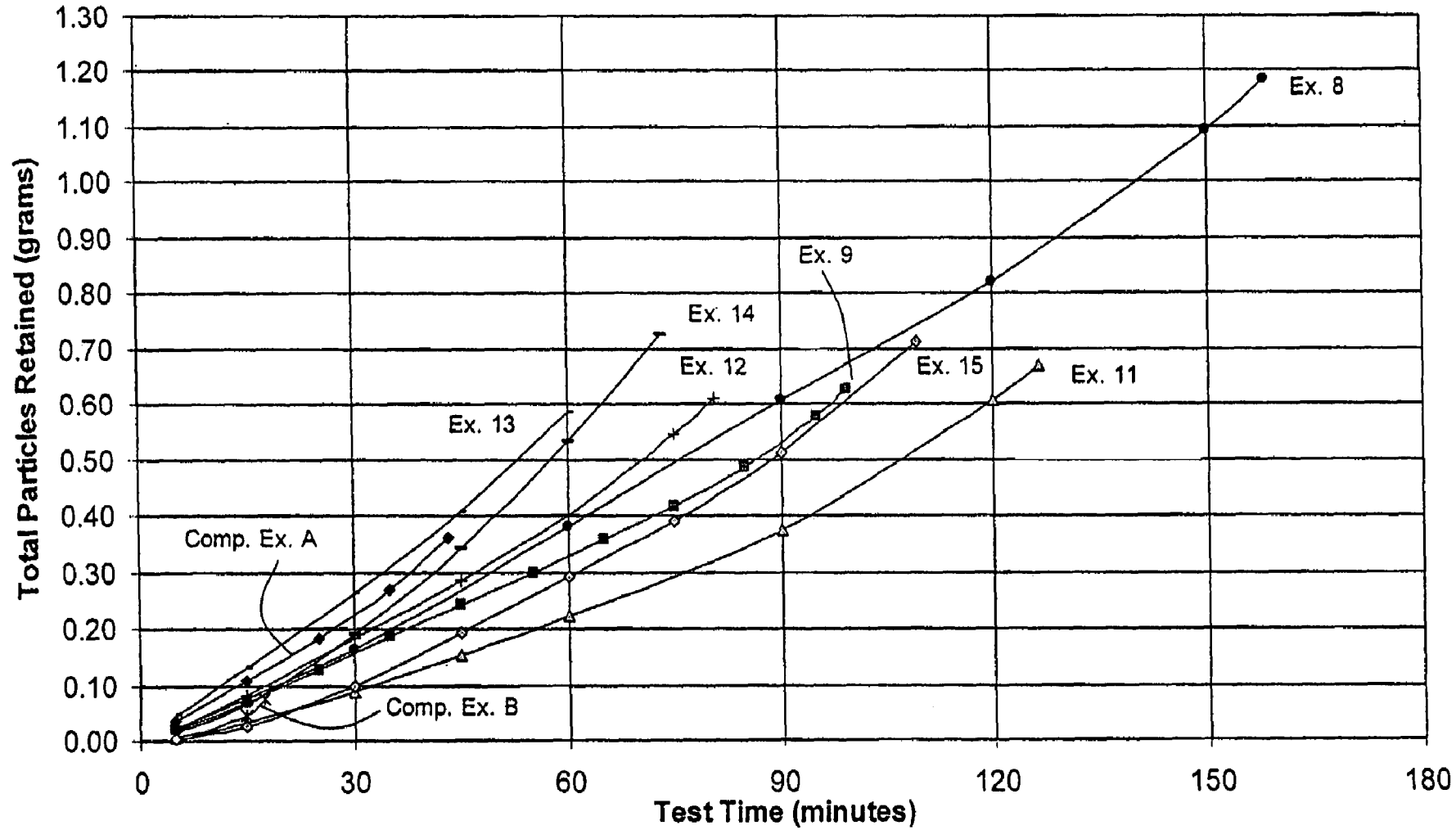
FIG. 9 is a graph showing the amount of retained particles as a function of time for tests involving various screen assemblies.

FIG. 8 shows the pressure drop as a function of time for samples prepared from the screen configurations of Examples 8, 9, and 11-15 and Comparative Examples A and B. It can be seen the screen configurations of Examples 8, 9, and 11-15 provide much longer service life (up to an order of magnitude higher) than the screen configurations of the Comparative Examples. FIG. 9 is a graph showing the amount of retained particles as a function of time for samples prepared from the screen configurations of Examples 8, 9, and 11-15 and Comparative Examples A and B. It can be seen that the inventive screens removed acceptable amounts of particles, and removed a greater amount of particles over the life of the filter than the screens of the Comparative Examples.

Thus, it can be seen that the particle control screens of the present invention reduce plugging in the filter assemblies and increase the particle holding capacity of the filters, thus giving the filters a longer life.

Although the present invention has been described with reference to preferred embodiments, those skilled in the art will recognize that changes may be made and formed in detail without departing from the spirit and scope of the invention. It is therefore intended that the foregoing detailed description be regarded as illustrative rather than limiting, and that it be understood that it is the following claims, including all equivalents, that are intended to define the scope of this invention.

What is claimed is:

1. A particle control screen, comprising:

a support layer;

a first filter layer disposed around the support layer;

a second filter layer disposed around the first filter layer;

a third filter layer disposed around the second filter layer, wherein each of the filter layers has a pore size, and the pore size of the third filter layer is greater than the pore size of the second filter layer, and the pore size of the second filter layer is greater than the pore size of the first filter layer; and wherein each of the filter layers is wire mesh.

2. The particle control screen of claim 1 wherein the support layer comprises a first support layer, further comprising a second support layer disposed around the first support layer.

3. The particle control screen of claim 1 further comprising a fourth filter layer disposed between the support layer and the first filter layer.

4. The particle control screen of claim 3 wherein the fourth filter layer has a pore size between 75 micron and 150 micron.

5. The particle control screen of claim 1 wherein the first filter layer has a pore size of between 75 and 300 micron, the second filter layer has a pore size of between 150 and 400 micron, and the third filter layer has a pore size of between 500 and 1200 micron.

6. The particle control screen of claim 1 wherein the first filter layer has a pore size of between 75 and 300 micron, the second filter layer has a pore size of between 150 and 400 micron, and the third filter layer has a pore size of between 200 and 500 micron.

7. The particle control screen of claim 1 wherein the first filter layer has a pore size of between 200 and 300 micron, the second filter layer has a pore size of between 300 and 450 micron, and the third filter layer has a pore size of between 600 and 800 micron.

8. The particle control screen of claim 1 wherein the first filter layer has a pore size of between 100 and 200 micron, the second filter layer has a pore size of between 250 and 350 micron, and the third filter layer has a pore size of between 500 and 600 micron.

9. A particle control screen, comprising:

a support layer;

a first filter layer disposed around the support layer;

a second filter layer disposed around the first filter layer;

a third filter layer disposed around the second filter layer, wherein each of the filter layers has a pore size, and the pore size of the third filter layer is greater than the pore size of the second filter layer, and the pore size of the second filter layer is greater than the pore size of the first filter layer;

wherein at least one of the filter layers is wire mesh; and further comprising a weld seam running the length of the particle control screen assembly and connecting each of the filter layers together, the weld seam contacting each of the filter layers.

10. A downhole assembly comprising:

a perforated base pipe; and a particle control screen assembly disposed around the base pipe, comprising:

a support layer;

a first filter layer disposed around the support layer and having a pore size between 75 and 300 micron;

a second filter layer disposed around the first filter layer and having a pore size of between 150 and 400 micron;

a third filter layer disposed around the second filter layer and having a pore size of between 200 and 1200 micron;

wherein at least a first end of the particle control screen assembly is circumferentially welded to the base pipe;

wherein at least one of the filter layers is wire mesh; and wherein each filter layer has a layer thickness of between 0.005 inch and 0.06 inch.

11. The downhole assembly of claim 10 wherein the support layer comprises a first support layer, further comprising a second support layer disposed around the first support layer.

12. The downhole assembly of claim 10 further comprising a fourth filter layer disposed between the support layer and the first filter layer.

13. The particle control screen of claim 10 wherein the filter layers are spirally wrapped around the base pipe.

14. The downhole assembly of claim 10 wherein the first filter layer has a pore size of between 200 and 300 micron, the second filter layer has a pore size of between 300 and 400 micron, and the third filter layer has a pore size of between 600 and 800 micron.

15. The downhole assembly of claim 10 wherein the first filter layer has a pore size of between 100 and 200 micron, the second filter layer has a pore size of between 250 and 350 micron, and the third filter layer has a pore size of between 500 and 600 micron.

16. The particle control screen of claim 10, wherein the particle control screen has a cross-section thickness of between about 0.02 inch and about 0.3 inch.

17. The particle control screen of claim 10, wherein the particle control screen has a cross-section thickness of between about 0.05 inch and about 0.15 inch.

18. The particle control screen of claim 10, wherein the particle control screen has a cross-section thickness of between about 0.07 inch and about 0.09 inch.

19. A downhole assembly comprising:

a perforated base pipe; and a particle control screen assembly disposed around the base pipe, comprising:

a support layer;

a first filter layer disposed around the support layer and having a pore size between 75 and 300 micron;

a second filter layer disposed around the first filter layer and having a pore size of between 150 and 400 micron;

a third filter layer disposed around the second filter layer and having a pore size of between 200 and 1200 micron;

wherein at least a first end of the particle control screen assembly is circumferentially welded to the base pipe; and wherein each of the filter layers is wire mesh.

20. A downhole assembly comprising:

a perforated base pipe; and a particle control screen assembly disposed around the base pipe, comprising:

a support layer;

a first filter layer disposed around the support layer and having a pore size between 75 and 300 micron;

a second filter layer disposed around the first filter layer and having a pore size of between 150 and 400 micron;

a third filter layer disposed around the second filter layer and having a pore size of between 200 and 1200 micron;

wherein at least a first end of the particle control screen assembly is circumferentially welded to the base pipe;

wherein at least one of the filter layers is wire mesh; and further comprising a weld seam running the length of the particle control screen assembly and connecting each of the filter layers together, the weld seam contacting each of the filter layers.

21. A method of filtering a fluid in a downhole formation comprising:

providing an assembly comprising:

a base pipe; and a particle control screen assembly comprising:

a support layer;

a first filter layer disposed around the support layer; and a second filter layer disposed around the first filter layer, wherein each of the filter layers has a pore size, and wherein the pore size of the second filter layer is greater than the pore size of the first filter layer, and wherein at least a first end of the particle control screen assembly is circumferentially welded to the base pipe;

disposing the assembly into a downhole formation comprising a fluid comprising heavy oil;

drawing in the fluid from the formation through the particle control screen assembly and into the base pipe, wherein the particle control screen assembly filters the fluid;

wherein at least one of the filter layers is wire mesh; and further comprising at least one additional mesh layer disposed between two adjacent filtration layers.

22. The method of claim 21 wherein the support layer comprises a first support layer, further comprising a second support layer disposed around the first support layer.

23. The method of claim 21 further comprising a third filter layer disposed around the second filter layer, wherein the pore size of the third filter layer is greater than the pore size of the second filter layer.

24. The method of claim 23 wherein the first filter layer has a pore size of between 100 and 300 micron, the second filter layer has a pore size of between 200 and 400 micron, and the third filter layer has a pore size of between 500 and 800 micron.

25. A method of filtering a fluid in a downhole formation comprising:

providing an assembly comprising:

a base pipe; and a particle control screen assembly comprising:

a support layer;

a first filter layer disposed around the support layer; and a second filter layer disposed around the first filter layer, wherein each of the filter layers has a pore size, and wherein the pore size of the second filter layer is greater than the pore size of the first filter layer, and wherein at least a first end of the particle control screen assembly is circumferentially welded to the base pipe;

disposing the assembly into a downhole formation comprising a fluid comprising heavy oil;

drawing in the fluid from the formation through the particle control screen assembly and into the base pipe, wherein the particle control screen assembly filters the fluid;

wherein at least one of the filter layers is wire mesh; and further comprising a weld seam running the length of the particle control screen assembly and connecting the filter layers together, the weld seam contacting each of the filter layers.

26. A particle control screen, comprising:

a support layer;

a first filter layer disposed around the support layer;

a second filter layer disposed around the first filter layer;

a third filter layer disposed around the second filter layer, wherein each of the filter layers has a pore size, and the pore size of the third filter layer is greater than the pore size of the second filter layer, and the pore size of the second filter layer is greater than the pore size of the first filter layer;

wherein at least one of the filter layers is wire mesh; and wherein each filter layer has a layer thickness of between 0.005 inch and 0.06 inch.

27. The particle control screen of claim 26, wherein the particle control screen has a cross-section thickness of between about 0.02 inch and about 0.3 inch.

28. The particle control screen of claim 26, wherein the particle control screen has a cross-section thickness of between about 0.05 inch and about 0.15 inch.

29. The particle control screen of claim 26, wherein the particle control screen has a cross-section thickness of between about 0.07 inch and about 0.09 inch.

30. A method of filtering a fluid in a downhole formation comprising:

providing an assembly comprising:

a base pipe; and a particle control screen assembly comprising:

a support layer;

a first filter layer disposed around the support layer; and a second filter layer disposed around the first filter layer, wherein each of the filter layers has a pore size, and wherein the pore size of the second filter layer is greater than the pore size of the first filter layer, and wherein at least a first end of the particle control screen assembly is circumferentially welded to the base pipe;

disposing the assembly into a downhole formation comprising a fluid comprising heavy oil;

drawing in the fluid from the formation through the particle control screen assembly and into the base pipe, wherein the particle control screen assembly filters the fluid;

wherein at least one of the filter layers is wire mesh; and wherein each filter layer has a layer thickness of between 0.005 inch and 0.06 inch.

31. The method of claim 30, wherein the particle control screen has a cross-section thickness of between about 0.02 inch and about 0.3 inch.

32. The method of claim 30, wherein the particle control screen has a cross-section thickness of between about 0.05 inch and about 0.15 inch.

33. The method of claim 30, wherein the particle control screen has a cross-section thickness of between about 0.07 inch and about 0.09 inch.

34. A particle control screen, comprising:

a support layer;

a first filter layer disposed around the support layer;

a second filter layer disposed around the first filter layer;

a third filter layer disposed around the second filter layer, wherein each of the filter layers has a pore size, and the pore size of the third filter layer is greater than the pore size of the second filter layer, and the pore size of the second filter layer is greater than the pore size of the first filter layer;

wherein at least one of the filter layers is wire mesh; and further comprising at least one additional mesh layer disposed between two adjacent filtration layers.

35. A downhole assembly comprising:

a perforated base pipe; and a particle control screen assembly disposed around the base pipe, comprising:

a support layer;

a first filter layer disposed around the support layer and having a pore size between 75 and 300 micron;

a second filter layer disposed around the first filter layer and having a pore size of between 150 and 400 micron;

a third filter layer disposed around the second filter layer and having a pore size of between 200 and 1200 micron;

wherein at least a first end of the particle control screen assembly is circumferentially welded to the base pipe;

wherein at least one of the filter layers is wire mesh; and further comprising at least one additional mesh layer disposed between two adjacent filtration layers.

* * * * *